United States Patent [19]

Bridges et al.

[11] 4,449,585

[45] May 22, 1984

[54] APPARATUS AND METHOD FOR IN SITU CONTROLLED HEAT PROCESSING OF HYDROCARBONACEOUS FORMATIONS

[75] Inventors: Jack E. Bridges, Park Ridge; Allen Taflove, Wilmette, both of Ill.

[73] Assignee: IIT Research Institute, Chicago, Ill.

[21] Appl. No.: 343,903

[22] Filed: Jan. 29, 1982

[51] Int. Cl.[3] ..... E21B 43/24

[52] U.S. Cl. ..... 166/248; 166/60; 166/245

[58] Field of Search ..... 166/52, 57, 60, 65 R, 166/245, 248, 302; 219/10.55 R, 10.65, 10.81

[56] References Cited

U.S. PATENT DOCUMENTS

| | | | |
|---|---|---|---|
| Re. 30,738 | 9/1981 | Bridges et al. | 166/248 |
| 3,948,319 | 4/1976 | Pritchett | 166/248 |
| 4,135,579 | 1/1979 | Rowland et al. | 166/248 |
| 4,140,179 | 2/1979 | Kasevich et al. | 166/248 |
| 4,140,180 | 2/1979 | Bridges et al. | 166/248 |
| 4,144,935 | 3/1979 | Bridges et al. | 166/248 |
| 4,193,451 | 3/1980 | Dauphine | 166/248 |

*Primary Examiner*—George A. Suchfield

*Attorney, Agent, or Firm*—Fitch, Even, Tabin & Flannery

[57] ABSTRACT

A system and method for the controlled in situ heat processing of hydrocarbonaceous earth formations involves the application of electromagnetic energy at a selected frequency or at selected frequencies to a waveguide structure formed by electrodes bounding a particular volume of hydrocarbonaceous material. Terminating one end of the structure with different impedances at different times produces electric field standing waves of different respective phase at that end at a selected frequency. Two standing waves substantially 90° out of phase in formations having relatively uniform dielectric properties result in substantially uniform application of heating power if the product of the amplitude-squared of the electric field standing wave and dwell time is substantially the same in each of the two modes. Feeding the line at both ends provides partial offset for attenuation. Various desired controlled heating patterns other than uniform may be effected by utilizing different dwell times or applied fields. Different frequencies provide further flexibility, particularly where the line is terminated differently at the respective frequencies. Energy at the different frequencies may be applied simultaneously.

58 Claims, 19 Drawing Figures

Fig. 4.
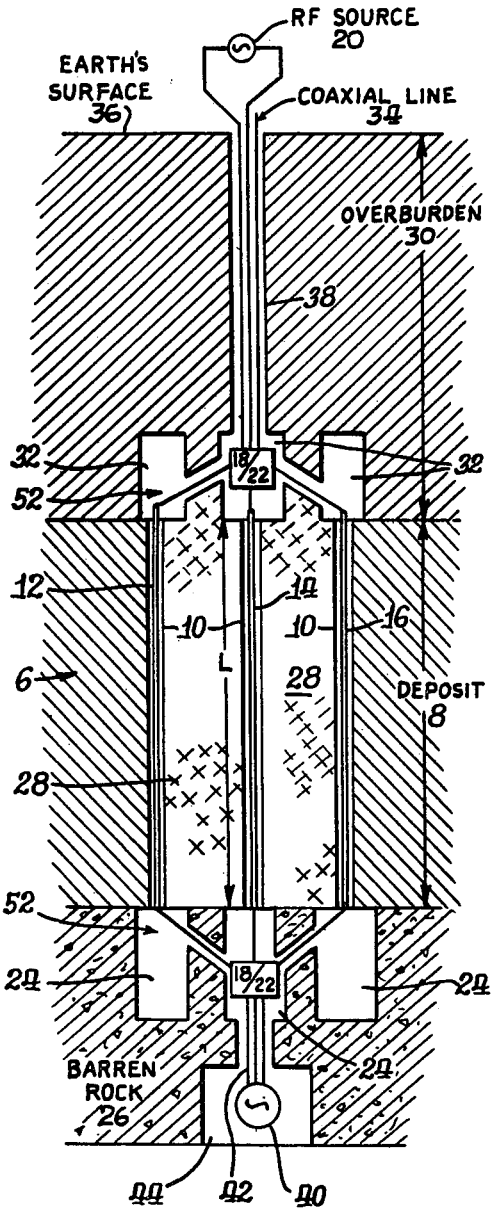
Fig. 5.
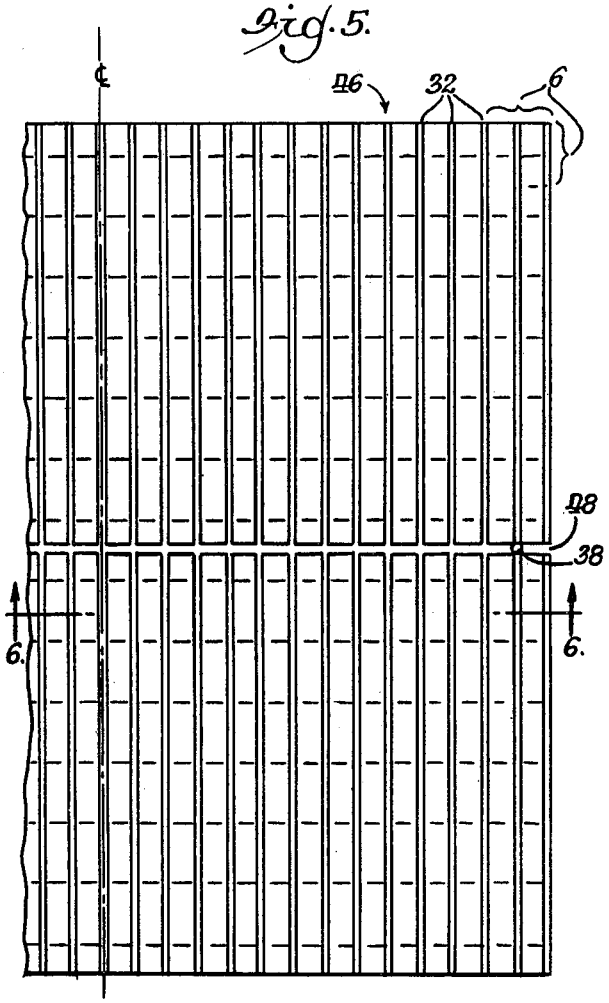
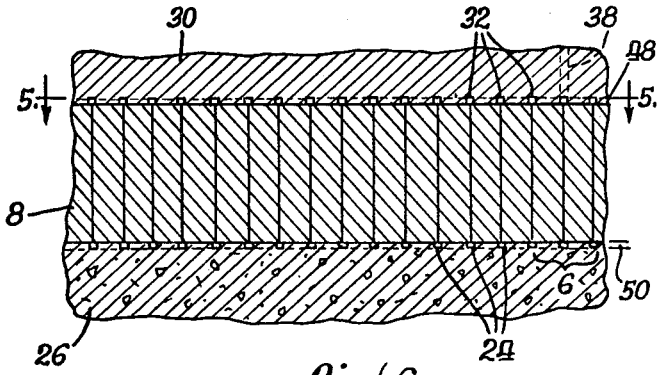
Fig. 6.

Fig. 11.
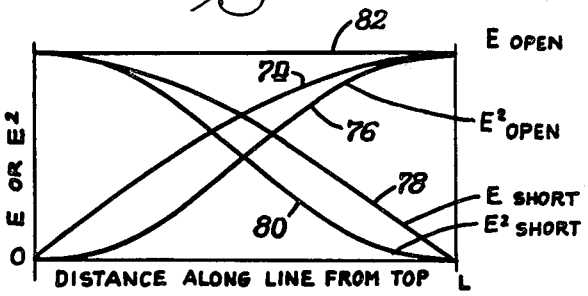
Fig. 12.
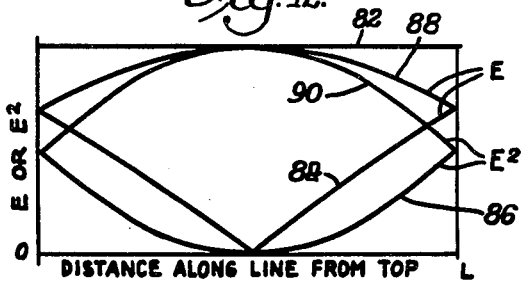
Fig. 13.
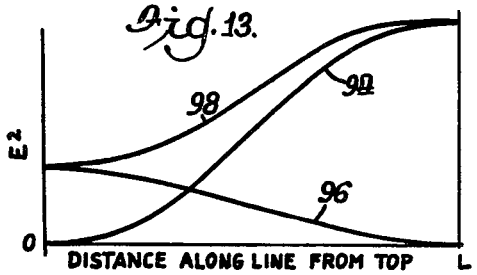
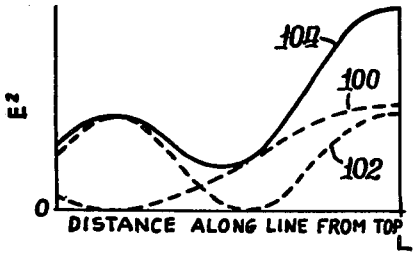
Fig. 14.
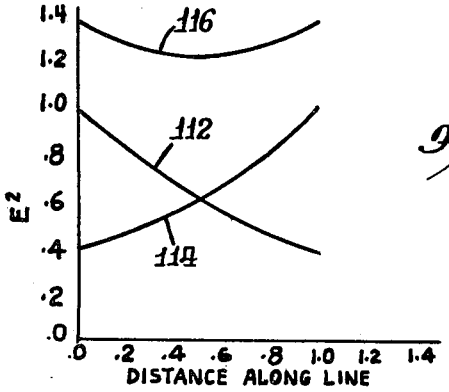
Fig. 16.
Fig. 9.
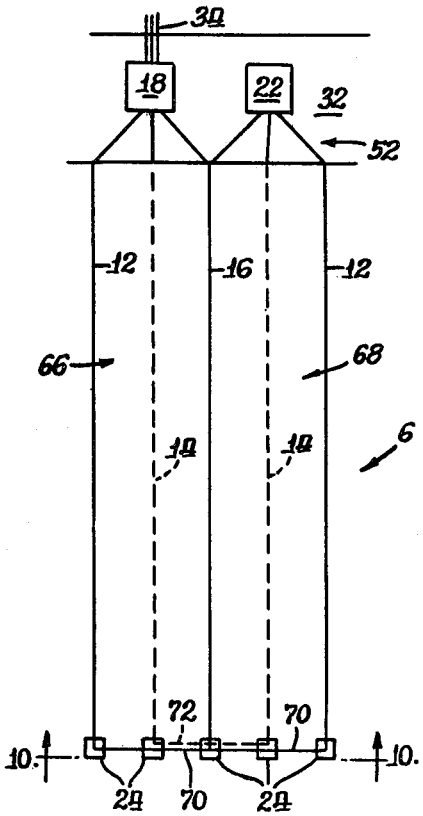
Fig. 10.
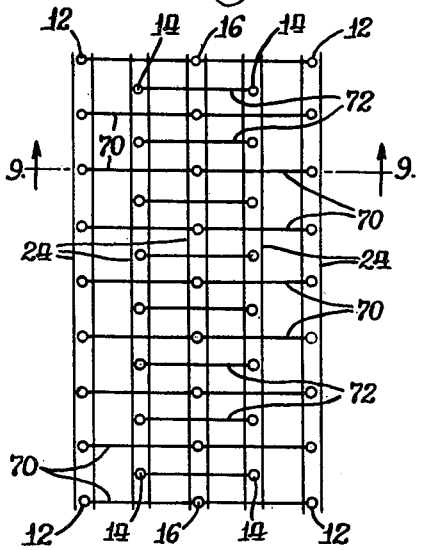

110
λ/4
E²
OPEN
106
108
SHORT
0
0
L
DISTANCE FROM SURFACE OF SHALE SEAM 126
126
124
118
E²
120
128
122
0
0 15 30 45 60 75 90 105 120 135 150 165 180
L
ELECTRICAL DISTANCE FROM TERMINATION IN DEGREES

APPARATUS AND METHOD FOR IN SITU CONTROLLED HEAT PROCESSING OF HYDROCARBONACEOUS FORMATIONS

BACKGROUND OF THE INVENTION

This invention relates to the recovery of marketable products such as oil and gas from hydrocarbon bearing deposits such as oil shale or tar sand by the application of electromagnetic energy to heat the deposits. More specifically, the invention relates to a method and system including use of a high power radio frequency signal generator and an arrangement of elongated electrodes, inserted in the earth formations for applying electromagnetic energy to provide controlled heating of the formations.

Materials such as oil shale, tar sands, and coal are amenable to heat processing to produce gases and hydrocarbonaceous liquids. Generally, the heat develops the porosity, permeability and/or mobility necessary for recovery. Oil shale is a sedimentary rock which, upon pyrolysis or distillation, yields a condensable liquid, referred to as shale oil, and non-condensable gaseous hydrocarbons. The condensable liquid may be refined into products which resemble petroleum products. Tar sand is an erratic mixture of sand, water and bitumen with the bitumen typically present as a film around water-enveloped sand particles. Using various types of heat processing, the bitumen can be separated. Also, as is well known, coal gas and other useful products can be obtained from coal using heat processing.

In the destructive distillation of oil shale or other solid or semi-solid hydrocarbonaceous materials, the solid material is heated to an appropriate temperature and the emitted products are recovered. The desired organic constituent of oil shale, known as kerogen, constitutes a relatively small percentage of the bulk shale material, so very large volumes of shale need to be heated to elevated temperatures in order to yield relatively small amounts of useful end products. The handling of the large amounts of material is, in itself, a problem, as is the disposal of wastes. Also, substantial energy is needed to heat the shale, and the efficiency of the heating process and the need for relatively uniform and rapid heating have been limiting factors on success. In the case of tar sands, the volume of material to be handled, as compared to the amount of recovered product, is again relatively large, since bitumen typically constitutes only about ten percent of the total, by weight. Material handling of tar sands is particularly difficult even under the best of conditions, and the problems of waste disposal are, of course, present here, too.

A number of proposals have been made for in situ methods of processing and recovering valuable products from hydrocarbonaceous deposits. Such methods may involve underground heating or retorting of material in place, with little or no mining or disposal of solid material in the formation. Valuable constituents of the formation, including heated liquids of reduced viscosity, may be drawn to the surface by a pumping system or forced to the surface by injecting another substance into the formation. It is important to the success of such methods that the amount of energy required to effect the extraction be minimized.

It has been known to heat relatively large volumes of hydrocarbonaceous formations in situ using radio frequency energy. This is disclosed in Bridges and Taflove U.S. Reissue Pat. No. Re. 30,738. That patent discloses a system and method for in situ heat processing of hydrocarbonaceous earth formations wherein a plurality of conductive means are inserted in the formations and bound a particular volume of the formations. As used therein, the term "bounding a particular volume" was intended to mean that the volume is enclosed on at least two sides thereof. In the most practical implementations the enclosed sides were enclosed in an electrical sense, and the conductors forming a particular side could be an array of spaced conductors. Electrical excitation means were provided for establishing alternating electric fields in the volume. The frequency of the excitation means was selected as a function of the dimensions of the bound volume so as to establish a substantially non-radiating electric field which was substantially confined in said volume. In this manner, volumetric dielectric heating of the formations occurred to effect approximately uniform heating of the volume.

In the preferred embodiment of the system described in that patent, the frequency of the excitation was in the radio frequency range and had a frequency between about 1 MHz and 40 MHz. In that embodiment, the conductive means comprised conductors disposed in respective opposing spaced rows of boreholes in the formations. One structure employed three spaced rows of conductors which formed a triplate-type of waveguide structure. The stated excitation was applied as a voltage, for example across different groups of the conductive means or as a dipole source, or as a current which excited at least one current loop in the volume. Particularly as the energy was coupled to the formations from electric fields created between respective conductors, such conductors were, and are, often referred to as electrodes.

The reissue patent disclosed the imposition of standing electromagnetic waves on the electrodes embedded in the formation. Such standing waves create a sinusoidally varying electric field along the length of the electrodes, with peaks and nodes separated by a distance equal to one quarter of the wavelength ($\lambda/4$) of the signal applied to the electrodes. This, in turn, creates a heating power which varies in strength along the length of the electrodes and which, consequently, gives rise to heating and temperature variations along the length of the electrodes. As it was desired to provide uniform heating, the system disclosed in that patent provided compensation for such variations in the following ways: (1) by modification of the phase or frequency of the excitation signal, and (2) by decreasing the effective insertion depth of some of the conductors by either pulling some of the conductors part way out of the formation or by employing small explosive charges to sever end segments of the conductors.

SUMMARY OF THE INVENTION

The present invention is an improvement upon the system and method described in U.S. Reissue Pat. No. Re. 30,738, utilizing the same sort of waveguide structure, preferably in the form of the same triplate transmission line. The teachings of that reissue patent are hereby incorporated herein by reference.

The present invention provides improved techniques for electromagnetically heating hydrocarbonaceous deposits. The reissue patent disclosed methods wherein the deposit could be uniformly heated by time averaging heat fields in a waveguide without substantial radiation. The present invention seeks to improve this by providing more control over the heating process to compensate for deposit heterogeneities, such as variations in dielectric properties with temperature or location, and spatial variations in density and heat requirements. Another improvement overcomes the previous limitation wherein the length of the waveguide was limited so that the 1/e attenuation distance was more than twice the actual physical dimension in order to achieve a reasonably uniform heating pattern. Further, the invention has the ability to heat formations along the axis of propagation selectively so as to avoid heating barren zones, or to allow certain portions of the deposit to be produced earlier to equalize production rates.

These improvements are achieved by physically loading one or more portions of the waveguide other than at the locations of the sources of electrical energy, controlling the impedance of these loads, controlling the time duration and/or level of electrical excitation for a given load condition, and alternating the positions of source and load.

Further benefit and heating control may be obtained by using two or more frequencies, either harmonically or non-harmonically related and either simultaneously or sequentially, wherein the waveguide termination impedances and the amplitude and duration of each frequency component are selected to produce a preselected integrated heating pattern. Typically, such predetermined patterns will be employed to achieve a reasonably uniform temperature rise in a heterogeneous deposit or to achieve a non-uniform temperature rise to avoid heating barren layers or to control production rates.

In certain aspects of the present invention, access is provided at the remote ends of the electrodes forming the line. The line is then terminated in alternative fashions to provide standing waves of different phases at a given selected frequency.

In the system and method of the present invention for the controlled in situ heat processing of hydrocarbonaceous earth formations, a plurality of electrodes are placed into a particular volume of hydrocarbonaceous material in a pattern which bounds the volume and defines a waveguide structure having the bounded volume as a dielectric medium bounded therein and which is configured such that the direction of propagation of aggregate modes of wave propagation therein is approximately parallel to an elongate axis of the electrodes. Electromagnetic energy is supplied to the wave guide structure at a frequency selected to confine the electromagnetic energy substantially in the structure and to dissipate the electromagnetic energy substantially to the earth formations. Terminating one end of the structure with different impedances at different times produces electric field standing waves of different respective phase at that end at the selected frequency.

In preferred embodiments the difference in phase is made substantially 90° in order that the resultant heating effects for the two respective standing waves be 180° out of phase. At least where the dielectric properties of the formations are relatively uniform, the combined effect of such change of phase is thus to provide substantially uniform heating when the product of the amplitude-squared of the electric field standing wave and the dwell time in the respective phase is substantially the same in the two modes. Such 90° phase shift may be effected by terminating the line alternately with substantially effectively open and short circuits. Pure resistive and pure reactive loads and combination resistive and reactive loads may also be used.

Access to the remote ends of the electrodes also permits feeding the line from either end. By feeding the line from each end alternately, the effect of attenuation down the line may be partly offset. In one form of the invention, power can be applied at both ends at the same time.

Different frequencies may be applied sequentially or simultaneously to the waveguide, whether the remote end is accessible or inaccessible, with the duration and amplitude of the electromagnetic energy associated with each frequency being selected to produce a predetermined heating pattern.

The present invention also contemplates a number of desired controlled heating patterns in addition to uniform. These may be achieved by utilizing different dwell times and/or different amplitudes of electric field for the different respective standing wave patterns. The use of different frequencies provides further flexibility in the heating patterns that can be established, particularly where the line is terminated differently at the respective frequencies. The invention also contemplates the application of electromagnetic energy at different frequencies at the same time while terminating the line differently at the different frequencies to provide a particular programmed heating pattern.

Thus, one aspect of the invention is to provide controlled heating patterns in hydrocarbonaceous earth formations by the controlled application of electromagnetic energy utilizing standing waves. Another aspect of the invention is to provide such controlled heating by controlling the phase of the standing waves by appropriate termination of the waveguide structure in the earth. Another aspect is the application of power at each end of the waveguide structure to make the heating pattern more uniform or to provide a particular controlled heating pattern. Another aspect of the invention is to provide controlled heating patterns by utilizing multiple frequencies and/or different dwell times or different amplitudes of electric field.

These and other aspects, objects and advantages of the present invention will become apparent from the following detailed description, particularly when taken in conjunction with the accompanying drawings.

BRIEF DESCRIPTION OF THE DRAWINGS

FIG. 4 is a vertical sectional view, partly diagrammatic, of another embodiment of the present invention having electromagnetic energy applied at both ends of the waveguide structure, the view corresponding to the section taken in FIG. 2;

FIG. 5 is a horizontal sectional view of an array of waveguide structures as shown in FIG. 4, taken along line 5—5 in FIG. 6;

FIG. 6 is a vertical sectional view of the array shown in FIG. 5, taken along line 6—6 in FIG. 5;

FIG. 9 is a vertical sectional view, partly diagrammatic, of another embodiment of the present invention having a folded waveguide structure, taken along line 9—9 in FIG. 10, the view corresponding to the section taken in FIG. 4;

FIG. 10 is a sectional view of the structure shown in FIG. 9, taken along line 10—10 in FIG. 9;

FIG. 11 is a somewhat idealized illustration of the standing waves and heating patterns produced by certain embodiments of the present invention with the waveguide structure terminating alternatively with a substantially effectively open circuit and a substantially effectively short circuit and with substantially the same average electromagnetic energy impressed at a single selected frequency in each mode;

FIG. 12 is an illustration corresponding to that of FIG. 11 wherein the waveguide structure is alternatively terminated substantially effectively capacitively and inductively;

FIG. 13 is an illustration corresponding to FIG. 11 showing heating patterns when electric fields of different amplitudes are applied under the respective conditions;

FIG. 14 is an illustration of the heat patterns developed by one form of the present invention with the waveguide structure terminating in substantially an effectively open circuit and with electromagnetic energy applied at two different frequencies;

FIG. 16 is an illustration of the heating patterns developed by one form of the present invention wherein electromagnetic energy is applied equally to both ends of the waveguide structure, and attenuation along the waveguide structure is taken into account;

DETAILED DESCRIPTION OF PREFERRED EMBODIMENTS

Figure 1:
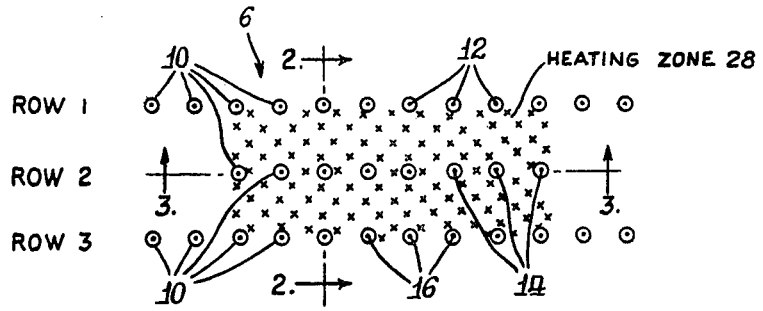
FIG. 1 is a diagrammatic illustration of a plan view of a triplate waveguide structure disposed in earth formations in accordance with an embodiment of the present invention.
Figure 2:
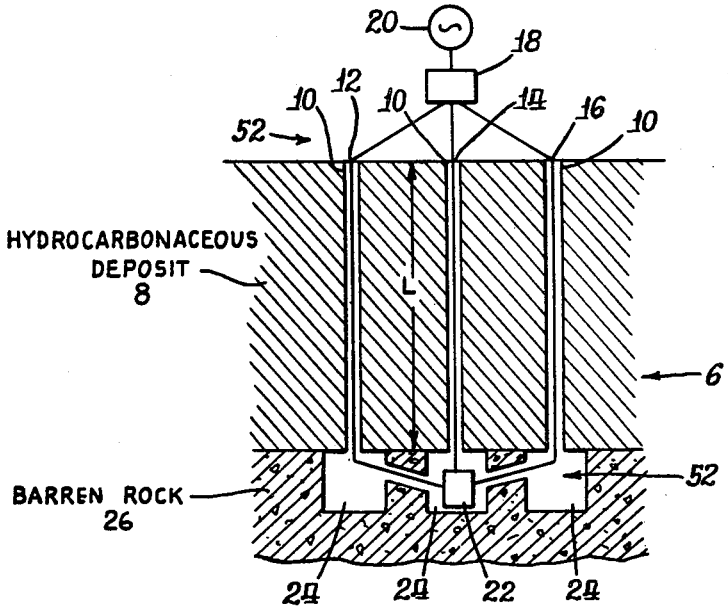
FIG. 2 is a diagrammatic illustration of a sectional view of the structure illustrated in FIG. 1, taken along line 2—2 in FIG. 1.
Figure 3:
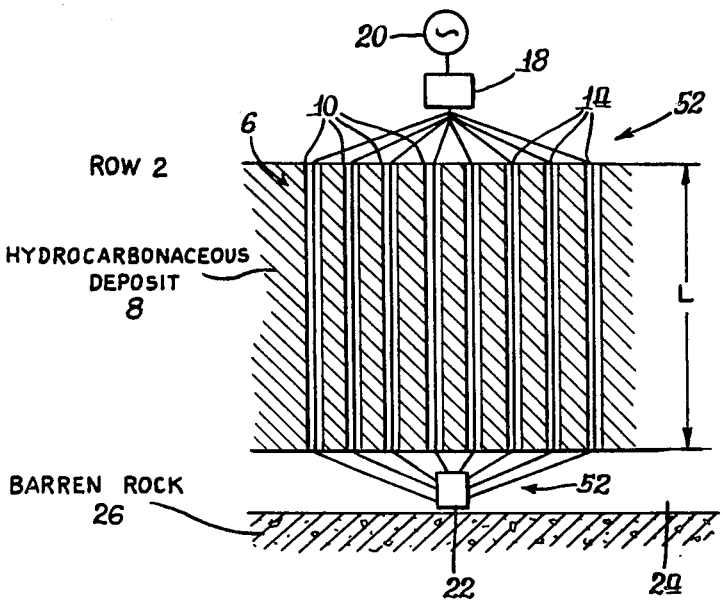
FIG. 3 is a diagrammatic illustration of a sectional view of the structure illustrated in FIG. 1, taken along line 3—3 in FIG. 1.

The present invention will be described primarily in respect to its application to a triplate waveguide structure as disclosed in Bridges and Taflove U.S. Reissue Pat. No. Re. 30,738. In FIGS. 1, 2 and 3 there is illustrated a simplified construction of one form of the present invention as applied to a triplate waveguide structure 6, particularly a structure as shown in FIGS. 4*a*, 4*b* and 4*c* of the reissue patent utilizing rows of discrete electrodes to form the triplate structure. The most significant difference between the system illustrated in FIGS. 1, 2 and 3 herein and that illustrated in the reissue patent is in the termination of the waveguide structure at its lower end.

FIG. 1 shows a plan view of a surface of a hydrocarbonaceous deposit 8 having three rows of boreholes 10 with elongated tubular electrodes 12, 14, 16 placed in the boreholes of respective rows. The individual elongated tubular electrodes 12, 14, 16 are placed in respective boreholes 10 that are drilled in relatively closely spaced relationship to form outer rows designated as row 1 and row 3, and a central row designated as row 2, with electrodes 12 in row 1, electrodes 14 in row 2 and electrodes 16 in row 3. The rows are spaced far apart relative to the spacing of adjacent electrodes of a row. FIG. 2 shows one electrode of each row. FIG. 3 illustrates the electrodes 14 of the central row, row 2. In the embodiment shown, the boreholes 10 are drilled to a depth L into the formations, where L is the approximate depth of the bottom boundary of the hydrocarbonaceous deposit 8. After insertion of the electrodes 12, 14, 16 into the respective boreholes 10, the electrodes 14 of row 2 are electrically connected together and coupled to one terminal of a matching network 18. The electrodes 12, 16 of the outer rows are also connected together and coupled to the other terminal of the matching network 18. Power is applied to the waveguide structure 6 formed by the electrodes 12, 14, 16, preferably at radio frequency. Power is applied to the structure from a power supply 20 through the matching network 18, which acts to match the power source 20 to the waveguide 6 for efficient coupling of power into the waveguide. The lower ends of the electrodes are similarly connected to a termination network 22 which provides appropriate termination of the waveguide structure 6 as required in various aspects of the present invention and as will be explained in greater detail below. As the termination network 22 is below ground level and cannot readily be implanted or connected from the surface, lower drifts 24 are mined out of the barren rock 26 below the deposit 8 to permit access to the lower ends of the electrodes 12, 14, 16, whereby the termination network 22 can be installed and connected.

The zone heated by applied energy is approximately that bounded by the electrodes 12, 16 and indicated by the cross-hatching of zone 28 in FIG. 1. The electrodes 12, 14 16 of the waveguide structure 6 provide an effective confining waveguide structure for the alternating electric fields established by the electromagnetic excitation. As will become understood, heating below L is minimized by appropriate termination of the waveguide structure at the lower end.

The use of an array of elongated cylindrical electrodes 12, 14, 16 to form a field confining waveguide structure 6 is advantageous in that installation of these units in boreholes 10 is more economical than, for example, installation of continuous plane sheets on the boundaries of the volume to be heated in situ. Also, enhanced electric fields in the vicinities of the borehole electrodes 12, 14, 16 through which recovery of the hydrocarbonous fluids ultimately occurs, is actually a benefit (even though it represents a degree of heating non-uniformity in a system where even heating is striven for) since the formations near the borehole electrodes will be heated first. This helps create initial permeability and porosity, which facilitates orderly recovery of fluids as the overall bounded volume later rises in temperature. To achieve field confinement, the spacing between adjacent electrodes of a respective row should be less than about a quarter wavelength and, preferably, less than about an eighth of a wavelength.

Very large volumes of hydrocarbonaceous deposits can be heat processed using the described technique, for example, volumes of the order of $10^5$ to $10^6$ $m^3$ of oil shale. Large blocks can, if desired, be processed in sequence by extending the lengths of the rows of boreholes 10 and electrodes 12, 14, 16. Alternative field confining structures and modes of excitation are possible and will be described further hereinbelow. Further field confinement can be provided by adding conductors in boreholes at the ends of the rows to form a shielding structure.

In FIGS. 1 to 3 it was assumed, for ease of illustration, that the hydrocarbonaceous earth formations formed a seam at or near the surface of the earth, or that any overburden had been removed. However, it will be understood that the invention is equally applicable to situations where the resource bed is less accessible and, for example, underground mining is required both above and below the deposit 8. In FIG. 4 there is shown a condition wherein a moderately deep hydrocarbonaceous bed 8, such as an oil shale layer of substantial thickness, is located beneath an overburden 30 of barren rock. In such instance, upper drifts 32 can be mined, and boreholes 10 can be drilled from these drifts. Again, each of these boreholes 10 represents one of a row of boreholes 10 for a triplate-type configuration as is shown in FIG. 3. After the boreholes 10 have been drilled, tubular electrodes 12, 14, and 16 are respectively lowered into the boreholes 10 in the resource bed 8. Coaxial lines 34 carry the energy from the power supply 20 at the surface 36 through a borehole 38 or an adit to the matching network 18 in a drift 32 for coupling to the respective electrodes 12, 14, 16. In this manner, there is no substantial heating of the barren rock of the overburden 30.

FIG. 4 illustrates an alternative embodiment of the present invention in that provision is made for applying power to the lower end of the triplate line 6 as well as to the upper end. To this end a second power supply 40 is provided at the lower end of the triplate line 6 and is coupled to a matching network 18 by a coaxial cable 42. The second power supply may be located in a drift 24 or in an adjacent drift 44, or it may be located at some distance, even at the surface. Indeed, the same power supply may be used for both ends of the line. In the embodiment shown in FIG. 4, a termination network 22 and a matching network 18 are supplied at each end of the waveguide structure 6. The termination/matching networks 18, 22 may be of conventional construction for coupling the respective power supplies 20, 40 to the waveguide 6 and, upon switching, for terminating the waveguide with an appropriate impedance. With power applied from the upper power supply 20, the network 18 provides appropriate matching to the line, and the network 22 provides appropriate termination impedance. With power applied from the lower power supply 40, it is the other way around. As will be discussed further below, the appropriate termination impedances will be whatever produces an appropriate phase of a standing wave or other desired property.

As mentioned above, the fuel in hydrocarbonaceous formations can be produced by operations in large blocks. To this end the waveguide structure 6 may be repeated many times. In FIGS. 5 and 6 is illustrated one aggregative arrangement that has been designed for commercial production. In this arrangement waveguide structures 6 of horizontal diamensions 20 m×20 m are disposed adjacent one another in a block 46 formed as a 14×14 array, with rows 1, 2, 3 spaced 10 m apart and five electrodes 12, 14, 16 in each row spaced 4 m apart. The outer electrodes of adjacent waveguide structures may be common. An upper master drift 48 connects the upper drifts 32, and a lower master drift 50 connects the lower drifts 24. The blocks 46 are then disposed in square 4×4 arrays, which are developed as a group. These arrays are themselves arranged in still larger groups covering the entire area to be produced. In the system designed, power is supplied from a given power supply 20, 40 for an entire row of waveguide structures 6 in a given block 46, with power being supplied to all 14 rows at the same time from respective power supplies.

Figure 8:
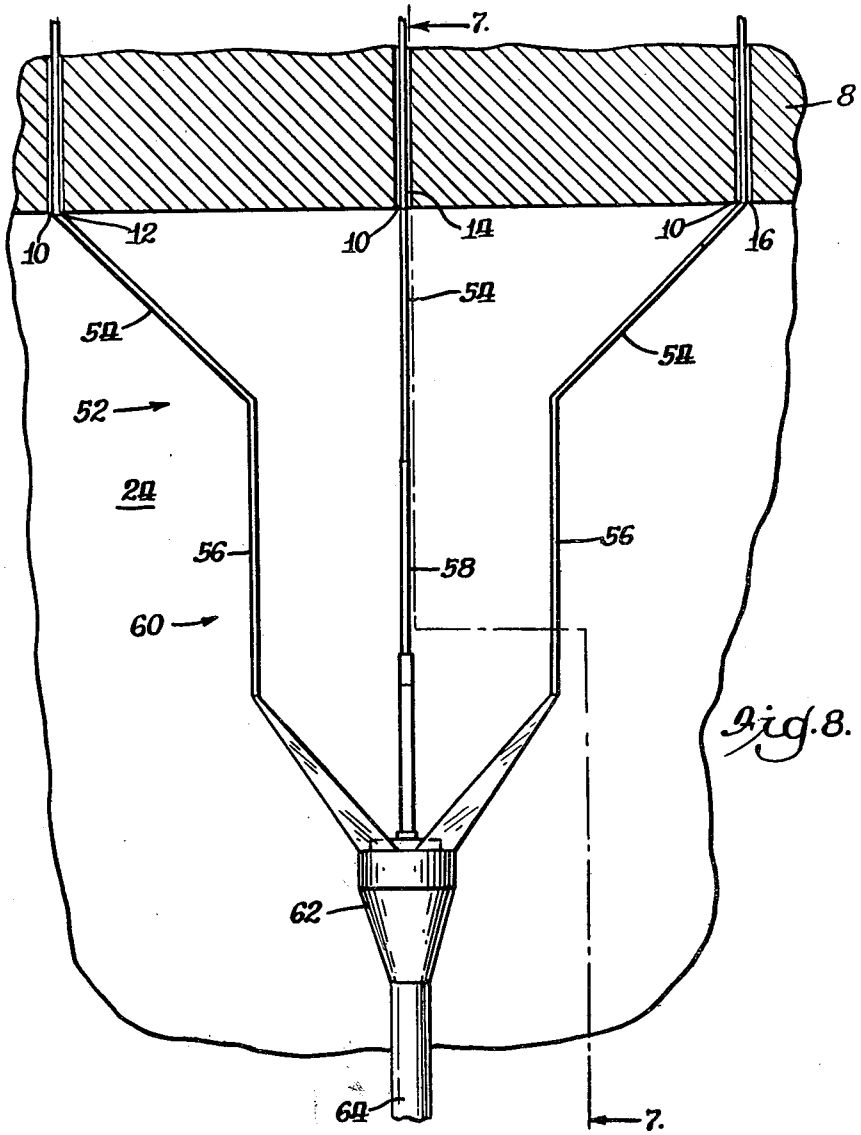
FIG. 8 is a sectional view of the transition coupling shown in FIG. 7, taken along line 8—8 in FIG. 7, with certain parts shown in full line.
Figure 7:
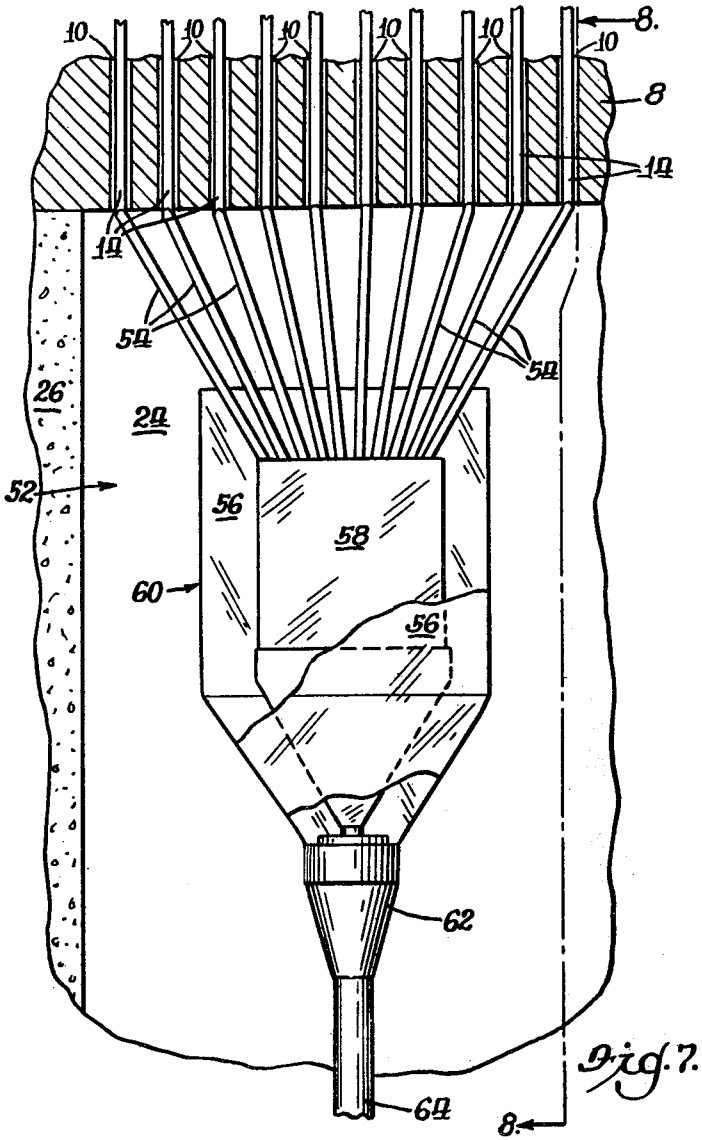
FIG. 7 is a side view, partly in section and with part broken away, of a transition coupling used with the waveguide structure shown in FIG. 4, taken along line 7—7 in FIG. 8.

As mentioned above, the matching networks 18 and the termination networks 22 may be relatively conventional networks per se. However, the manner in which they are coupled to the waveguide structure 6 is somewhat special. It is desired to provide smooth coupling without complicating reflections of electric fields and yet maintaining appropriate phase relationships. A particular transition coupling 52 that has been found to be suitable is illustrated in FIGS. 7 and 8. As there shown, straps or tubes 54 are welded from the ends of respective electrodes 12, 14, 16 to a respective plate 56 or 58 of a triplate transition assembly 60, the outer electrodes 12, 16 being thereby connected to the outer plates 56 and the center electrodes 14 to the inner plate 58. The plates 56, 58 are then connected to a coaxial cable coupling 62 which in turn is connected to a coaxial cable 64. The coaxial cable 64 is then connected to the matching network 18 and/or the termination network 22, as desired.

In FIGS. 9 and 10 is illustrated a variation of the embodiment shown in FIG. 4. In this embodiment, the waveguide structure 6 is effectively folded so as to present both ends at the top. The two ends may be considered axially separated even though they are laterally adjacent, as the energy goes down one leg and back the other. The waveguide structure 6 is formed of two parallel parts 66 and 68. At their lower ends, the electrodes 12 of the respective parts are serially connected together and to the electrodes 16, which are common to both parts, by metal straps or tubes 70, and the electrodes 14 of the respective parts are connected together by metal straps or tubes 72. The composite waveguide structure 6 is then formed of a plurality of physically parallel and electrically serial sections disposed side by side. The remote end of the waveguide structure 6 is thus at the top end of the part 68. The termination network 22 can then be positioned adjacent the matching network 18, and the two networks 18, 22 respectively switched from one end to the other of the waveguide structure 6.

FIGS. 11 to 17 show various heating patterns illustrative of those that may be developed utilizing various aspects of the present invention.

In FIG. 11 is illustrated the heating patterns developed upon two particular terminations of the waveguide structure 6 and the pattern developed by combining the two. For the sake of illustration, the waveguide structure 6 has a length L equal to one-fourth of the wavelength ($\lambda/4$) of the electromagnetic energy applied to the waveguide structure 6 by an RF power supply 20, 40. Put another way, the frequency of such power supply has been selected to make the wavelength equal to 4L. It is also assumed that attenuation down the line is negligible. In this case, if the line is terminated in an open circuit, a standing wave is developed in the electric field E in the form shown by curve 74. In formations with uniform dielectric properties, the power applied to the formations varies as the square of the electric field ($E^2$) and hence varies as shown by curve 76. If the termination network 22 is then switched to terminate the line in a short circuit, a standing wave is developed in the electric field in the form shown by curve 78, applying power that varies as shown by the $E^2$ curve 80. Under the assumed conditions, all of curves 74–80 will be sine waves, with curves 76 and 80 180° out of phase. As a consequence, if the power is applied in each mode to produce an electric field standing wave of the same amplitude-squared for the same dwell time, the total power heating the formations, the sum of curves 76 and 80, will be uniform along the waveguide structure 6, as shown by curve 82. The same result is obtained if a greater electric field E is applied for a lesser time in one mode, so long as the product of the amplitude-squared $E^2$ of the electric field standing wave and dwell time is substantially the same in the two modes.

To simplify the discussion in connection with FIG. 11, we have chosen an example wherein the dielectric properties of the deposit are reasonably uniform, as is often the case. In this case, the power dissipated per unit volume throughout the deposit will be properly proportional to the square of electric field. Where the dielectric properties of the deposit are not relatively uniform, the relationship between applied electric field and the heating power distribution is more complex. On the other hand, one of the objectives of this invention is to compensate for variations in the dielectric properties of the deposit. A related objective is to vary the heating to compensate for variations in specific heat, evaporation, pyrolysis, endothermic and exothermic reactions, thermal conduction, heat transfer by liquid flow and density. As will be shown below, the applied electric field can be controlled in such manner that the power dissipated along the line varies in a predetermined manner to compensate for these factors.

In FIG. 12 is illustrated the heating patterns developed for two other particular terminations of the waveguide structure 6 under the same assumptions, with the difference in phase of the heating patterns being likewise 180°. With the line terminated capacitively, the standing wave of the electric field E takes the form illustrated by curve 84, the resulting power distribution being shown by $E^2$ curve 86. Similarly, with the line terminated inductively, the standing wave of the electric field E takes the form illustrated by curve 88, the resulting power distribution being shown by $E^2$ curve 90. The sum of curves 86 and 90 is also a straight line 82, indicating a uniform distribution of power heating the formations.

As should be evident from the examples of FIGS. 11 and 12, any pair of terminations that do not absorb power and that provide a 90° phase difference between the phases of the respective electric field standing waves place the respective heating patterns 180° out of phase and produce a uniform heating distribution if the electric field standing wave amplitude-squared ($E^2$) and dwell time are the same in the two modes, or the product of electric field standing wave amplitude-squared ($E^2$) and dwell time is the same for each mode.

The effective termination impedance is what is seen at the end of the waveguide structure 6. This does not require an actual short or open circuit at that point to produce the conditions illustrated in FIG. 11. If the effective length of the transition coupling 52 and the coaxial cable 64 with its coupling 62 is made one-fourth wave length ($\lambda/4$) at the selected frequency, a short circuit at the distal end of the cable 64 effectively makes an open circuit at the end of the wave guide structure 6, and an open circuit at the distal end of the cable 64 effectively makes a short circuit at the end of the waveguide structure 6. By adjusting the length of the cable 64, any desired phase may be established for a standing wave at a respective frequency, including the conditions illustrated in FIG. 12. Substantially effectively open and short circuits are preferred alternative termination impedances because they can be readily established empirically by measuring voltage or current at the end of the waveguide structure 6 and varying the length of the cable 64 when terminated in an open or short circuit until maxima or minima are noted, as the case may be.

In FIG. 13 is illustrated the combination of heating patterns where the magnitudes of the electric field and/or dwell times are different, as might be applied to a heterogeneous medium. In this case, an open circuit pattern as shown by curve 94 is combined with a short circuit pattern as shown by curve 96 where the amplitude-squared ($E^2$) of the electric field standing wave and/or dwell time of the open circuit mode is greater than that of the short circuit mode. The integral is then more heavily weighted toward the open circuit pattern, as shown by curve 98. Here it is desired to enhance the heating at the distal end, as to compensate for variations in the deposit or loss of heat out the end of the heated section.

In FIG. 14 is illustrated another combined heating pattern. In this case, two different frequencies are applied to the waveguide structure 6 with effectively open circuit termination, preferably both frequencies are applied at the same time. Under these circumstances; respective heating patterns as shown by curves 100 and 102 have respective maxima at the end of the waveguide structure 6, but their adjacent minima are displaced from one another, making an integrated heating pattern as shown by curve 104.

Figure 15:
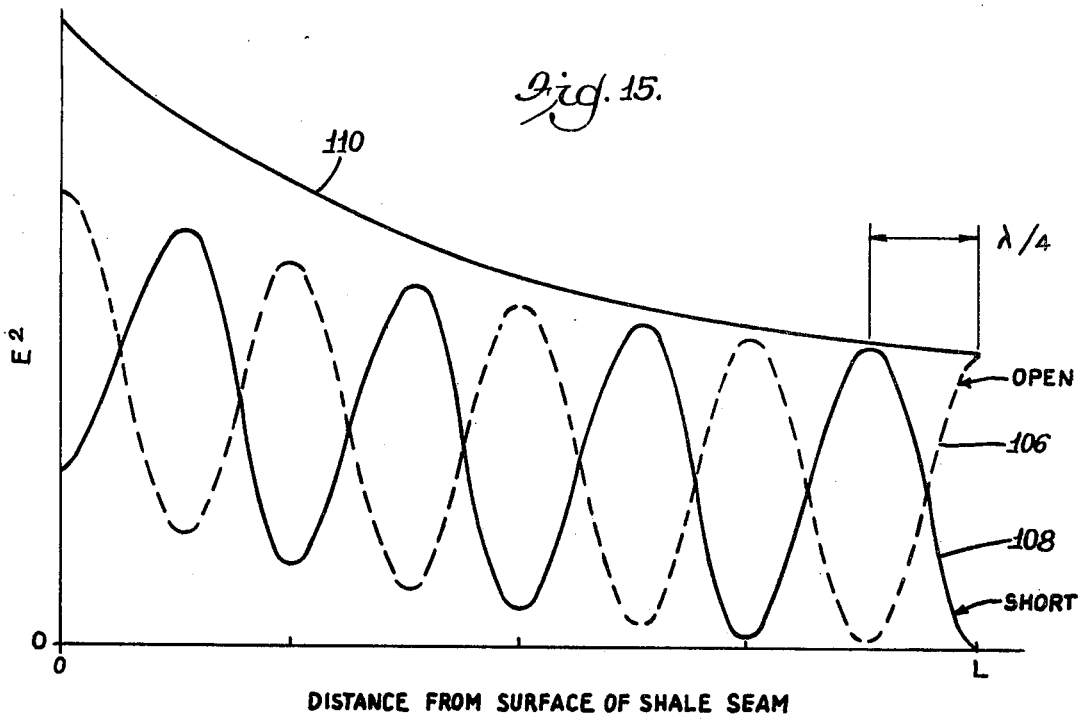
FIG. 15 is an illustration of the heating patterns developed under the conditions of FIG. 11, wherein attenuation along the waveguide structure is taken into account.

In respect to the curves of FIGS. 11 to 14, the effects of attenuation of the supplied electromagnetic energy down the line have been ignored. In the real world, where the object is to introduce electromagnetic energy into the formations, there is appreciable loss of power as the electromagnetic waves progress down the line, as recognized in Bridges and Taflove U.S. Reissue Pat. No. Re. 30,738, FIG. 8. In FIG. 15 herein, curve 106 represents the power distribution under the conditions described in connection with FIG. 8 of the reissue patent, that is, with the waveguide structure 6 terminated in an open circuit. Curve 108 represents the power distribution when the line is terminated by a short circuit. With the product of the amplitude-squared of the electric field standing wave and dwell time the same in each mode, the integral of the two curves 106 and 108 is in the form illustrated by curve 110, an exponential curve.

The curve 110 is comparable to the curve illustrated in FIG. 9 of the reissue patent, where the smoothing of the heating was effected by physically changing the length of the center electrodes. It is to be noted, however, that for the sake of uniform heating distribution, the length of the center electrodes was limited in the reissue patent to less than half the 1/e attenuation distance. In accordance with a preferred embodiment of the present invention, the relatively uniform distribution of heat can be greatly extended by applying energy from both ends of the line as illustrated by FIG. 16.

In FIG. 16 is illustrated the effect of applying energy from both ends of the line. With electromagnetic energy applied at one end of the waveguide structure 6 at two different times at a selected frequency with open and short circuit termination, respectively, at the other end and the product of the amplitude-squared of the electric field standing wave and dwell time is the same in each mode, the heating distribution is as shown by curve 112, for the reasons given above in connection with FIG. 15. When the system is reversed and the same power is applied at the other end with the one end appropriately terminated, the heating distribution is just the reverse, as shown by curve 114. The integral of curves 112 and 114 is curve 116, which illustrates the total heating power distribution for all modes. This shows a much flatter distribution of power for a much greater attenuation in each direction, thus extending the useful range of electrode lengths for relatively uniform heating distribution.

FIG. 16 also illustrates a useful embodiment of the invention when there is little or no standing wave created. This will occur when the waveguide structure 6 is so long as to provide a very large attenuation along the line, as where the waveguide is folded a number of times. This will also occur if the line is terminated in an apparent resistance so as to preclude any substantial reflection. A resistive termination, as the term is used herein, is one which absorbs or redirects the energy reaching the termination with relatively little or no substantial reflection. In this case, the energy apparently dissipated at the end of the line can be routed, as by coaxial cable, to other formations or rectified to supply DC electrical power to the system. In the case where there is no standing wave, the curves 112 and 114 nevertheless represent heating distribution for power applied at the respective ends of the waveguide structure 6, and curve 116 represents the combined heating distribution from both modes. In this embodiment, power can be applied to both ends of the line at the same time at the same or different frequencies.

Figure 17:
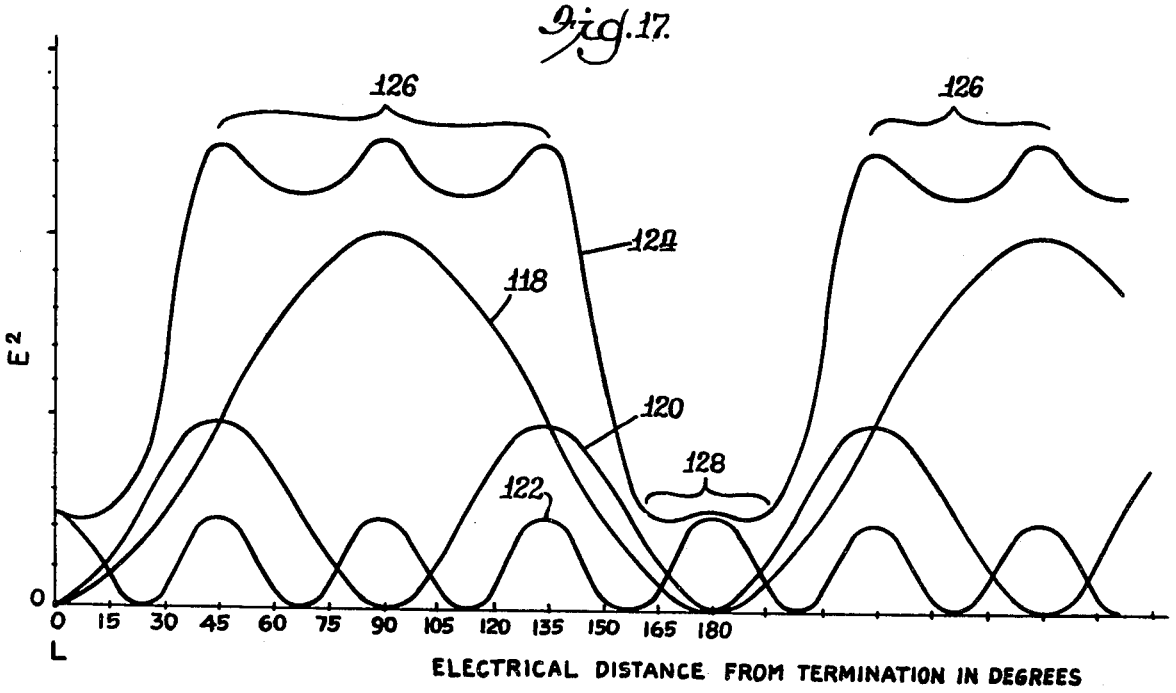
FIG. 17 is an illustration of the heating patterns developed by one form of the present invention with multiple frequencies applied and different terminations of the waveguide at respective frequencies.

In another embodiment of the invention, related to that illustrated by FIG. 14, electromagnetic energy may be applied at a number of different frequencies at the same or different times with the line terminated differently at different frequencies. This permits a greater number of combined heating patterns. FIG. 17 illustrates an example of an overall heating pattern produced in this manner. Curves 118, 120 and 122 represent the heating patterns for standing waves produced by applied frequencies at a fundamental frequency (curve 118) and second (curve 120) and fourth (curve 122) harmonics thereof, with the line terminated respectively in short, short and open circuits. The combined heating pattern is as shown by curve 124. The terminated end of the line is to the left in FIG. 17. As may be noted, the combined heating pattern is characterized by relatively flat plateaus 126 separated by a valley 128. Such a distribution is helpful where the hydrocarbonaceous formation is interrupted by a barren stratum. The valley 128 in the heating distribution may be made to occur in the barren stratum. Similarly, where a folded waveguide structure 6 is utilized, the valley 128 may be made to occur at the fold. The beginning point of a pattern may be established by the termination impedances. The combined pattern is determined by the length L of the center electrodes 14 and the magnitude and duration of the respective applications of power at the different selected frequencies.

The combined heating pattern 124 may also be used to overcome variations in properties such as the electrical absorption, specific heat, mass, and heat of vaporization typical of a heterogeneous deposit. For example, consider a fortuitous combination of these parameters wherein more heat is required in the region of the deposit underlying the plateaus 126 rather than the valley 128. It is obvious that the combined curve is capable of supplying the additional heat needed in the regions of the deposit related to the plateaus 126 in order to realize a uniform temperature rise of the overall deposit.

Figure 18:
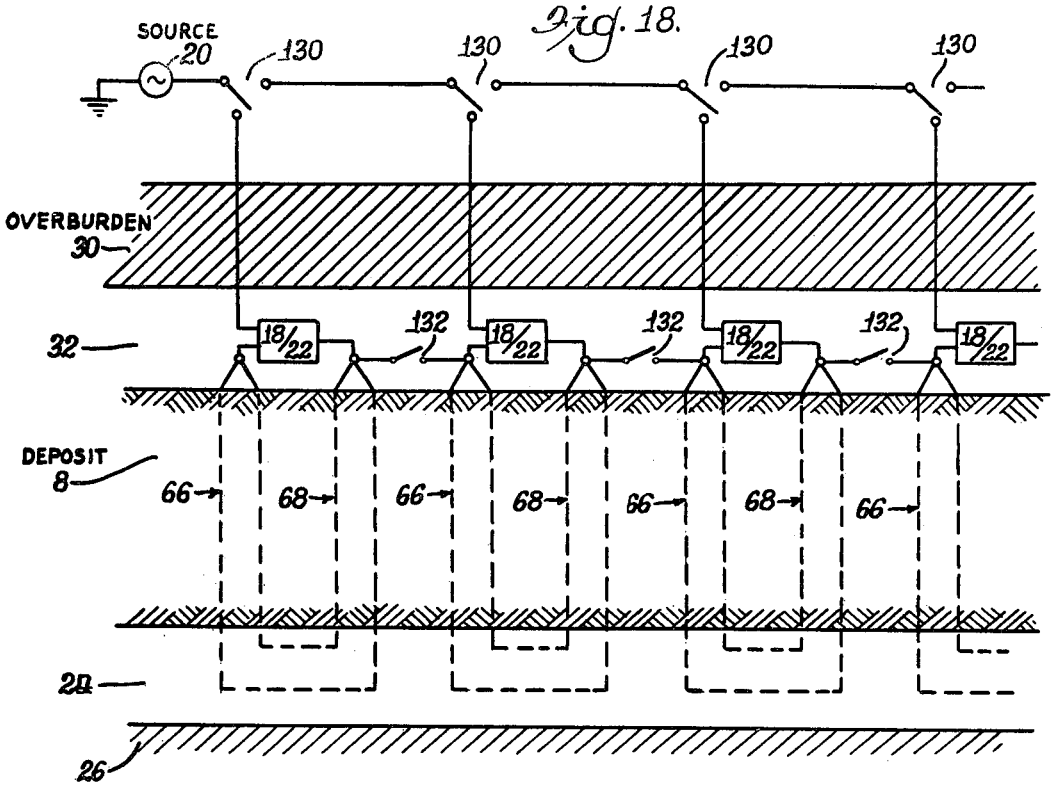
FIG. 18 is a vertical sectional view, partly diagrammatic, of an array of waveguide structures as shown in FIG. 9.

FIG. 18 illustrates a preferred embodiment for arranging a plurality of the systems illustrated in FIGS. 9 and 10 in a row. A single source 20 is switchable by switches 130 to feed respective folded wave guide structures 6, with the respective matching networks 18 and termination networks 22 switchable to either end of the respective lines. Among other modes, this permits feeding either end of each line or even at other points along a line. Switches 132 permit series connection of several waveguide structures 6 to form a longer composite waveguide structure.

Figure 19:
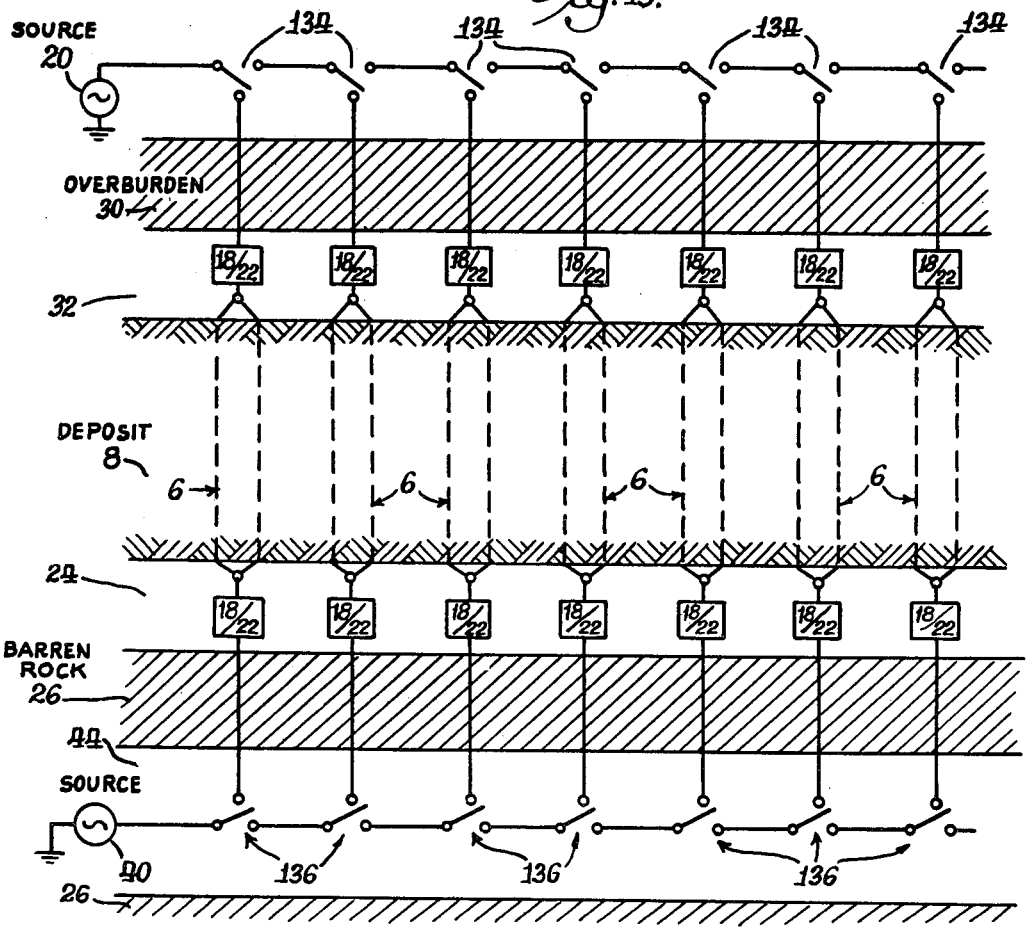
FIG. 19 is a vertical sectional view, partly diagrammatic, of an array of waveguide structures as shown in FIG. 4.

FIG. 19 illustrates a preferred embodiment for arranging a plurality of the systems illustrated in FIG. 4 in a row. A single source 20 is switchable by switches 134 to feed the wave guide structure 6 from the top, and a single source 40 is switchable by switches 136 to feed them from the bottom, with the respective matching networks 18 and termination networks 22 being correspondingly switchable.

There are thus a number of aspects of the present invention that provide improved controlled electromagnetic heating of hydrocarbonaceous deposits in situ. Provision is made for more uniform heating in a simpler manner as well as for other controlled heating patterns. It is to be kept in mind that uniform application of electric field does not assure the uniform application of power. The earth formations have variations in dielectric properties, both with temperature and spatially. They also vary as the constituency of the formations change upon operation of the method. There are also variations in thermal capacity, density and specific heat. The dielectric properties change markedly as water is driven off. Unless the formations are relatively uniform in character, the uniform application of electric power does not effect uniform temperature rise. It is common for uniform application of electric power to produce substantially uniform temperature rise; however, non-uniform controlled application of electromagnetic energy in accordance with the present invention may be used to produce relatively uniform temperature rise in formations having substantial heterogeneities. Of course, non-uniform controlled application of electromagnetic energy may be used to produce a desired temperature distribution. It is particularly applicable to conditions where there are barren zones interspersed in the hydrocarbonaceous deposits, for wasteful heating of such zones can be reduced while concentrating heating in the adjacent deposits. Controlled non-uniform heating has been shown to be helpful in allowing certain portions of a deposit to be produced first, as to equalize production rates. It may be desirable to produce lower portions of a deposit first in order to improve permeability for producing the upper portions by gravity through the lower portions.

Controlled heating patterns are achieved in accordance with certain aspects of this invention by changing the termination impedance of the waveguide structure to create standing waves having a desired different phase at a selected frequency. The duration (dwell time) of each mode and/or the level of electromagnetic excitation may be varied to control heating patterns. The points of application of power and termination of the line may be varied to provide different heating patterns, as by supplying energy at one end and terminating the other and then switching ends. Variation in controlled heating patterns are also achieved by applying energy at multiple frequencies at the same time or sequentially, harmonically related or not.

A particular improvement is achieved by application of energy at both ends of the line, whether simultaneously or sequentially. This permits a more uniform application of heating and overcomes the previous limitation that twice the length of the waveguide be no more than the 1/e attenuation distance.

Although particular preferred embodiments of the invention have been described with particularity, many modifications may be made therein with the scope of the invention. Other controlled heating patterns may be created using the present invention. Other electrode structures may be used, and they may be disposed differently, such as horizontally. Other transition couplings and terminations may be used. It should also be noted that termination need not be at the structural or physical ends of a waveguide structure. It is the end from the aspect of electrical circuitry that is significant. By definition, electrical termination in the manner described herein provides an effective electrical end.

The invention is applicable to a system in which a waveguide structure is formed by electrodes disposed in earth formations, where the earth formations act as the dielectric for the waveguide. Electromagnetic energy at a selected frequency or at selected frequencies, preferably at radio frequencies, is supplied to the waveguide for controlled dissipation in the formations.

The terms "waveguide" and "waveguide structure" are used herein, unless the context otherwise requires, in the broad sense of a system of material boundaries capable of guiding electromagnetic waves. This includes the triplate transmission line formed of discrete electrodes as preferred for use in the present invention.

Unless otherwise required by the context, the term "dielectric" is used herein in the general sense of a medium capable of supporting an electric stress and recovering at least a portion of the energy required to establish an electric field therein. The term thus includes the dielectric earth media considered here as imperfect dielectrics which can be characterized by both real and imaginary components, $\epsilon'$, $\epsilon''$. A wide range of such media are included wherein $\epsilon''$ can be either larger or smaller than $\epsilon'$.

"Radio frequency" will similarly be used broadly herein, unless the context requires otherwise, to mean any frequency used for radio communications. Typically this ranges upward from 10 KHz; however, frequencies as low as 45 Hz have been considered for a world-wide communications system for submarines. The frequencies currently comtemplated for a large commercial oil shale facility range from 30 KHz to 3 MHz and for tar sand deposits as low as 50 Hz.

In the example described above as designed for commercial operation in 14×14 blocks as used in large oil shale blocks about $4\times10^6$ m$^3$, each containing 5 to $6\times10^6$ barrels of oil (as is believed reasonably representative of certain oil shales), the heating time would be about 60 days and the applied power about 500 Mw. This power would be carried into deposits by fourteen 36 Mw coaxial cables of about a meter outer diameter. These cables would excite an array of 14×14 triplate lines. The electrodes of these triplate lines would also serve as product collection paths. The heat would decompose the kerogen in oil shales to the point where permeability is developed in the formations by interconnected pores. These interconnected pores would allow the valuable fluids to be collected at the electrodes for extraction. In the case of a tar sand deposit, the viscosity of the tars would be lowered to permit recovery by a conventional petroleum recovery method.

What is claimed is:

1. A method for the controlled in situ heat processing of hydrocarbonaceous earth formations comprising the steps of:

placing a plurality of electrodes into a particular volume of hydrocarbonaceous material in a pattern which bounds said volume and defines a waveguide structure having said bounded volume present as a dielectric medium bounded therein, and which is configured such that the direction of propagation of aggregate modes of wave propogation therein is approximately parallel to an elongate axis of said electrodes, said structure having first and second axially displaced ends;

supplying electromagnetic energy to said waveguide structure at a frequency selected to confine said electromagnetic energy substantially in said structure and to dissipate said electromagnetic energy substantially to the earth formations; and terminating one end of said structure with different effective termination impedances at different times to produce electric field standing waves of different respective phase at said one end at the selected frequency.

2. A method according to claim 1 wherein said energy is supplied at the other of said ends.

3. A method according to claim 1 wherein electromagnetic energy is supplied to said waveguide structure at a plurality of axially displaced points.

4. A method according to claim 3 wherein said points are at said first and second ends.

5. A method according to claim 4 wherein energy is supplied at said first and second ends at the same time.

6. A method according to claim 4 wherein energy is supplied at said first and second ends at the different times.

7. A method according to claim 4 wherein said one of said ends is an end opposite to an end to which such energy is supplied at the time.

8. A method according to claim 1 wherein said energy is supplied at different such frequencies.

9. A method according to claim 8 wherein said energy is supplied at said different frequencies simultaneously.

10. A method according to claim 9 wherein said different frequencies are harmonically related.

11. A method according to claim 8 wherein the selected frequencies, magnitude of power supplied at the respective frequencies, the duration of application thereof, and the phases of the standing waves produce a combined application of energy differing in a controlled predetermined manner to respective axially displaced portions of the earth formations.

12. A method according to claim 1 wherein the duration of application of power at said respective different times is controlled to provide a controlled axial distribution of average power applied to the earth formations.

13. A method according to any one of claims 1 to 12 wherein said one end is terminated by a substantially effectively open circuit and a substantially effectively short circuit at said respective different times.

14. A method according to any one of claims 1 to 12 wherein said one end is terminated by a substantially effectively impedance and a substantially effectively inductive impedance at said respective different times.

15. A method according to any one of claims 1 to 12 wherein said respective phases of the electric field standing waves are substantially 90° apart.

16. A method according to claim 15 wherein said respective different times are substantially equal.

17. A method according to claim 15 wherein the product of dwell time and the amplitude-squared of the electric field standing wave when said structure is terminated with one of said impedances is substantially equal to the product of dwell time and the amplitude-squared of the electric field standing wave when said structure is terminated with another of said impedances.

18. A method according to claim 1 wherein the product of dwell time and the amplitude-squared of the electric field standing wave when said structure is terminated with one of said impedances is substantially equal to the product of dwell time and the amplitude-squared of the electric field standing wave when said structure is terminated with another of said impedances.

19. A method for the controlled in situ heat processing of hydrocarbonaceous earth formations comprising the steps of:

placing a plurality of electrodes into a particular volume of hydrocarbonaceous material in a pattern which bounds said volume and defines a waveguide structure having said bounded volume present as a dielectric medium bounded therein, and which is configured such that the direction of propagation of aggregate modes of wave propagation therein is approximately parallel to an elongate axis of said electrode, said structure having first and second axially displaced ends;

supplying electromagnetic energy to said waveguide structure simultaneously at a plurality of respective frequencies selected to confine said electromagnetic energy substantially in said structure and to dissipate said electromagnetic energy substantially to the earth formations; and terminating one end of said structure with different effective impedances at the respective frequencies at the same time to produce standing waves of different respective phase at said one end at the respective selected frequencies.

20. A method according to claim 19 wherein said different frequencies are harmonically related.

21. A method according to claim 19 wherein the selected frequencies, magnitudes of power supplied at the respective frequencies, the duration of application thereof, and the phases of the standing waves produce a combined application of energy differing in a controlled predetermined manner to respective axially displaced portions of earth formations.

22. A method for the controlled in situ heat processing of hydrocarbonaceous earth formations comprising the steps of:

placing a plurality of electrodes into a particular volume of hydrocarbonaceous material in a pattern which bounds said volume and defines a waveguide structure having said bounded volume present as a dielectric medium bounded therein, and which is configured such that the direction of propagation of aggregate modes of wave propagation therein is approximately parallel to an elongate axis of said electrode;

supplying electromagnetic energy to said waveguide structure simultaneously at a plurality of respective frequencies selected to confine said electromagnetic energy substantially in said structure and to dissipate said electromagnetic energy substantially to the earth formations; and terminating one end of said structure with an effective termination impedance producing an electric field standing wave at each selected frequency, the respective standing waves producing heating minima axially displaced from one another.

23. A method according to claim 22 wherein said termination impedance is substantially the same at all frequencies.

24. A method according to claim 23 wherein said one end of said structure is terminated in a substantially effectively open circuit.

25. A method for the controlled in situ heat processing of hydrocarbonaceous earth formations comprising the steps of:

placing a plurality of electrodes into a particular volume of hydrocarbonaceous material in a pattern which bounds said volume and defines a waveguide structure having said bounded volume present as a dielectric medium bounded therein, and which is configured such that the direction of propagation of aggregate modes of wave propagation therein is approximately parallel to an elongate axis of said electrode, said structure having first and second axially displaced ends; and supplying electromagnetic energy to said waveguide structure at each of said ends thereof at a frequency selected to confine said electromagnetic energy substantially in said structure and to dissipate said electromagnetic energy substantially to the earth formations.

26. A method according to claim 25 including terminating the respective end of said structure opposite an end to which such energy is supplied at the time in a manner producing an electric field standing wave.

27. A method according to claim 25 including terminating the respective end opposite an end to which such energy is supplied at the time in an effectively resistive termination providing suppression of reflection of the applied energy at said terminated end.

28. A method for the controlled in situ heat processing of hydrocarbonaceous earth formations comprising the steps of:

placing a plurality of electrodes into a particular volume of hydrocarbonaceous material in a pattern which bounds said volume and defines a waveguide structure having said bounded volume present as a dielectric medium bounded therein, and which is configured such that the direction of propagation of aggregate modes of wave propogation therein is approximately parallel to an elongate axis of said electrodes, said structure having first and second axially displaced ends;

supplying electromagnetic energy to said waveguide structure at a frequency selected to confine said electromagnetic energy substantially in said structure and to dissipate said electromagnetic energy substantially to the earth formations; and terminating one end of said structure with an effectively resistive termination impedance to suppress reflection of the applied energy at said one end.

29. A system for the controlled in situ heat processing of hydrocarbonaceous earth formations, comprising a waveguide structure including a plurality of elongate electrodes and configured such that the direction of propagation of aggregate modes of wave propagation therein is approximately parallel to an elongate axis of said electrodes and bounding a particular volume of earth formations as a dielectric medium bounded therein, said structure having respective first and second axially separated ends;

means for supplying electromagnetic energy to said waveguide structure at a frequency selected to confine said electromagnetic energy substantially in said structure and to dissipate said electromagnetic energy substantially to the earth formations; and termination means for providing a selectable one of a plurality of different effective termination impedances at one of said ends of said structure, each impedance providing an electric field standing wave of respective phase at said one end at the selected frequency, said termination means including means for selecting respective ones of said termination impedances.

30. A system according to claim 29 wherein said means for supplying energy includes means for supplying such energy at the other of said ends.

31. A system according to claim 29 wherein said means for supplying electromagnetic energy includes means for supplying such energy to said waveguide structure at a plurality of axially displaced points.

32. A system according to claim 31 wherein said means for supplying such energy at a plurality of points includes means for supplying such energy at said first and second ends.

33. A system according to claim 32 wherein said means for supplying such energy includes means for supplying such energy at said first and second ends at the same time.

34. A system according to claim 32 wherein said means for supplying such energy includes means for supplying such energy at said first and second ends at different times.

35. A system according to claim 32 wherein said one of said ends is an end opposite to an end to which such energy is supplied at the time.

36. A system according to claim 29 wherein said means for supplying energy includes means for supplying such energy at different such frequencies.

37. A system according to claim 36 wherein said means for supplying energy includes means for supplying such energy at said different frequencies simultaneously.

38. A system according to claim 37 wherein said termination means includes means for providing different impedances at respective frequencies at the same time.

39. A system according to claim 37 wherein said different frequencies are harmonically related and derived from a single source.

40. A system according to claim 36 wherein the selected frequencies, the magnitudes of the power supplied at the respective frequencies and the phases provided by the respective impedances produce a combined application of energy differing in a controlled predetermined manner to respective axially displaced portions of the earth formations.

41. A system according to any one of claims 29 to 40 wherein said termination impedances consist of two impedances providing respective phases of the electric field standing waves at said one end substantially 90° apart.

42. A system according to any one of claims 29 to 40 wherein said termination impedances are respective substantially effectively open and short circuits.

43. A system according to any one of claims 29 to 40 wherein said termination impedances are respective substantially effectively capacitive and inductive loads.

44. A system according to any one of claims 29 to 40 wherein said waveguide structure is formed by a plurality of serially connected parallel laterally offset sections.

45. A system according to claim 44 wherein said waveguide structure comprises a folded triplate line.

46. A system according to claim 45 wherein first and second ends are at substantially the same elevation.

47. A system according to claim 46 including means for exchanging the connections at the respective first and second ends.

48. A system for the controlled in situ heat processing of hydrocarbonaceous earth formations, comprising a waveguide structure including a plurality of elongate electrodes and configured such that the direction of propagation of aggregate modes of wave propagation therein is approximately parallel to an elongate axis of said electrodes and bounding a particular volume of earth formations as a dielectric medium bounded therein, said structure having respective first and second axially separated ends; and means for simultaneously supplying electromagnetic energy to said waveguide structure at a plurality of respective frequencies selected to confine said electromagnetic energy substantially in said structure and to dissipate said electromagnetic energy substantially to the earth formations, said structure terminating at one of said ends in an effective termination impedance providing an electric field standing wave at each selected frequency, the respective standing waves producing heating minima axially displaced from one another.

49. A system according to claim 48 wherein said termination impedance is substantially the same at all selected frequencies.

50. A system according to claim 49 wherein said termination impedance is a substantially effectively open circuit.

51. A system for the controlled in situ heat processing of hydrocarbonaceous earth formations, comprising a waveguide structure comprising a plurality of elongate electrodes and configured such that the direction of propagation of aggregate modes of wave propagation therein is approximately parallel to an elongate axis of said electrodes and bounding a particular volume of earth formations as a dielectric medium bounded therein, said structure having respective first and second axially separated ends; and means for supplying electromagnetic energy to said waveguide structure at each of said ends thereof at a frequency selected to confine said electromagnetic energy substantially in said structure and to dissipate said electromagnetic energy substantially to the earth formations.

52. A system according to claim 51 including termination means at the respective end of said structure opposite an end to which such energy is supplied at the time for providing a termination impedance at said respective end, said impedance providing an electric field standing wave in said structure.

53. A system according to claim 51 including termination means at the respective end of said structure opposite an end to which such energy is supplied at the time for providing an effectively resistive termination impedance at said respective end, said impedance providing suppression of reflection of the applied energy at said respective end.

54. A system for the controlled in situ heat processing of hydrocarbonaceous earth formations, comprising a waveguide structure including a plurality of elongate electrodes and configured such that the direction of propagation of aggregate modes of wave propagation therein is approximately parallel to an elongate axis of said electrodes and bounding a particular volume of earth formations as a dielectric medium bounded therein, said structure having respective first and second axially separated ends;

means for supplying electromagnetic energy to said waveguide structure at a frequency selected to confine said electromagnetic energy substantially in said structure and to dissipate said electromagnetic energy substantially to the earth formations; and termination means for providing an effectively resistive termination impedance at one of said ends of said structure, said impedance providing suppression of reflection of the applied energy.

55. A method for the controlled in situ heat processing of hydrocarbonaceous earth formations comprising the steps of:

placing a plurality of electrodes into a particular volume of hydrocarbonaceous material in a pattern which bounds said volume and defines a waveguide structure having said bounded volume present as a dielectric medium bounded therein, and which is configured such that the direction of propagation of aggregate modes of wave propagation therein is approximately parallel to an elongate axis of said electrode, said structure having first and second axially displaced ends; and supplying electromagnetic energy to said waveguide structure at each of said ends thereof at a frequency selected to confine said electromagnetic energy substantially in said structure and to dissipate said electromagnetic energy substantially to the earth formations, said energy being supplied at different times to respective said ends.

56. A method according to claim 55 including terminating the respective end opposite an end to which such energy is supplied at the time in an effectively resistive termination providing suppression of reflection of the applied energy at said terminated end.

57. A system for the controlled in situ heat processing of hydrocarbonaceous earth formations, comprising a waveguide structure comprising a plurality of elongate electrodes and configured such that the direction of propagation of aggregate modes of wave propagation therein is approximately parallel to an elongate axis of said electrodes and bounding a particular volume of earth formations as a dielectric medium bounded therein, said structure having respective first and second axially separated ends; and means for supplying electromagnetic energy to said waveguide structure at each of said ends thereof at different times at a frequency selected to confine said electromagnetic energy substantially in said structure and to dissipate said electromagnetic energy substantially to the earth formations.

58. A system according to claim 57 including termination means at the respective end of said structure opposite an end to which such energy is supplied at the time for providing an effectively resistive termination impedance at said respective end, said impedance providing suppression of reflection of the applied energy at said respective end.

* * * * *

UNITED STATES PATENT AND TRADEMARK OFFICE

CERTIFICATE OF CORRECTION

PATENT NO. : 4,449,585

DATED : May 22, 1984

INVENTOR(S) : Jack E. Bridges and Allen Taflove

It is certified that error appears in the above-identified patent and that said Letters Patent is hereby corrected as shown below:

Column 8, line 1, "diamensions" should read --dimensions--.

Column 8, line 1, "20 m x20m" should read --20m x 20m--.

Column 10, line 5, "wave length" should read --wavelength--.

Column 10, line 7, "wave guide" should read --waveguide--.

Column 10, line 38, change the comma to a semicolon.

Column 10, line 39, "circumstances;" should read --circumstances,--.

Column 12, line 31, "wave guide" should read --waveguide--.

Column 14, line 29, Claim 1, "propogation" should read --propagation--.

UNITED STATES PATENT AND TRADEMARK OFFICE

CERTIFICATE OF CORRECTION

PATENT NO. : 4,449,585

DATED : May 22, 1984

INVENTOR(S) : Jack E. Bridges and Allen Taflove

It is certified that error appears in the above-identified patent and that said Letters Patent is hereby corrected as shown below:

Column 15, line 14, Claim 14, after "effectively" (first instance) insert --capacitive--.

Column 16, line 67, Claim 28, "propogation" should read --propagation--.

Signed and Sealed this

*Eleventh* Day of *December 1984*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,449,585

DATED : May 22, 1984

INVENTOR(S) : Jack E. Bridges, et al.

It is certified that error appears in the above-identified patent and that said Letters Patent is hereby corrected as shown below:

Column 1, after the first paragraph insert the following paragraph: --The Government of the United States of America has rights in this invention pursuant to Contract No. DE-AC01-79ER10181 awarded by the U.S. Department of Energy.--

Signed and Sealed this

Twenty-eighth Day of November 1989

*Attest:*

JEFFREY M. SAMUELS

*Attesting Officer*

*Acting Commissioner of Patents and Trademarks*